US011753763B2

(12) United States Patent
Welch et al.

(10) Patent No.: US 11,753,763 B2
(45) **Date of Patent: *Sep. 12, 2023**

(54) FABRIC TREATING APPLIANCE WITH PELLETIZER

(71) Applicant: WHIRLPOOL CORPORATION, Benton Harbor, MI (US)

(72) Inventors: Rodney Michael Welch, Eau Claire, MI (US); Erica Roberts, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/553,982

(22) Filed: Dec. 17, 2021

(65) Prior Publication Data

US 2022/0106728 A1 Apr. 7, 2022

Related U.S. Application Data

(63) Continuation of application No. 16/663,401, filed on Oct. 25, 2019, now Pat. No. 11,230,806.

(60) Provisional application No. 62/785,765, filed on Dec. 28, 2018.

(51) Int. Cl.

| | |
|---|---|
| ***D06F 58/22*** | (2006.01) |
| ***D06F 25/00*** | (2006.01) |
| ***D06F 39/10*** | (2006.01) |

(52) U.S. Cl.

CPC ..... *D06F 58/22* (2013.01); *D06F 25/00* (2013.01); *D06F 39/10* (2013.01)

(58) Field of Classification Search

CPC ..... D06F 58/22; D06F 25/00; D06F 39/10; D06F 58/00; D06F 39/00

USPC ..... 34/595–610

See application file for complete search history.

(56) References Cited

U.S. PATENT DOCUMENTS

| | | | | |
|---|---|---|---|---|
| 1,594,361 | A | 8/1926 | Frankenstein | |
| 3,769,818 | A | 11/1973 | Smith | |
| 4,217,667 | A | 8/1980 | Whitehouse | |
| 4,314,409 | A | 2/1982 | Cartier et al. | |
| 5,762,171 | A * | 6/1998 | Mizer | D01B 1/04 19/41 |
| 7,886,458 | B2 * | 2/2011 | Blair | F26B 25/007 34/628 |
| 8,667,705 | B2 | 3/2014 | Shin et al. | |
| 9,139,950 | B2 | 9/2015 | Barrett et al. | |
| 9,316,440 | B2 | 4/2016 | Kim et al. | |
| 10,077,528 | B2 | 9/2018 | Yoichi et al. | |
| 10,815,610 | B2 | 10/2020 | Lee et al. | |
| 11,015,281 | B2 | 5/2021 | Grider et al. | |
| 11,230,806 | B2 * | 1/2022 | Welch | D06F 58/22 |

(Continued)

FOREIGN PATENT DOCUMENTS

| | | | | |
|---|---|---|---|---|
| EP | 341450 A | * | 11/1989 | D01G 23/02 |
| EP | 2495363 A1 | | 9/2012 | |

(Continued)

*Primary Examiner* — Stephen M Gravini

(74) *Attorney, Agent, or Firm* — McGarry Bair PC

(57) ABSTRACT

A laundry treating appliance having a lint pelletizer whereby clothing fibers retained within a fluid can be extracted from the fluid and formed into a pellet. The laundry treating appliance can be a clothes washer or a clothes dryer. The clothes washer or clothes dryer can be a vertical or horizontal axis, either of which can be top-loading or front loading.

20 Claims, 4 Drawing Sheets

(56) References Cited

U.S. PATENT DOCUMENTS

| | | | | |
|---|---|---|---|---|
| 2019/0093279 | A1 | 3/2019 | Grider et al. | |
| 2020/0208336 | A1 | 7/2020 | Masters et al. | |
| 2020/0208337 | A1 | 7/2020 | Welch et al. | |
| 2021/0108352 | A1 | 4/2021 | Erickson et al. | |
| 2021/0214882 | A1* | 7/2021 | Grider ..... | D06F 58/22 |

FOREIGN PATENT DOCUMENTS

| | | | |
|---|---|---|---|
| EP | 3460121 | A1 | 3/2019 |
| EP | 3460121 | B1 | 5/2020 |
| EP | 3674476 | A1 | 7/2020 |
| EP | 3674477 | A1 | 7/2020 |

* cited by examiner

FABRIC TREATING APPLIANCE WITH PELLETIZER

CROSS-REFERENCE TO RELATED APPLICATIONS

This application is a continuation of U.S. patent application Ser. No. 16/663,401, filed Oct. 25, 2019, now U.S. Pat. No. 11,230,806, issued Jan. 25, 2022, which claims the benefit of U.S. Provisional Patent Application No. 62/785,765, filed on Dec. 28, 2018, both of which are incorporated herein by reference in their entirety.

BACKGROUND

Lint is any type of fiber that separates from clothing and is a byproduct of washing, drying or treating clothing in a fabric treating appliance, such as a clothes washer, clothes dryer or combination clothes washer/dryer, as part of an automatic cycle of operation. In many fabric treating appliances, the lint is entrained in the waste liquid, which, depending on the machine, is ultimately flushed down the household drain.

The nature of lint when it is entrained in waste water, especially its fine size, makes it difficult to trap or filter conveniently in the fabric treating appliance or in a municipal waste treatment plant receiving the waste water for processing. While entrained lint can be filtered from a waste liquid stream, it can quickly clog filters and because of its string-like shape, it can be difficult to remove from the filter.

BRIEF SUMMARY

A laundry treating appliance comprising: a treating chamber with a fluid circuit; a lint trap fluidly coupled to the fluid circuit; and a lint pelletizer having an inlet coupled to the lint trap; whereby lint from the fluid circuit is trapped by the line lint trap and formed into a pellet by the lint pelletizer.

A method for pelletizing lint entrained in waste liquid in a household appliance, the method comprising: trapping the lint from the waste liquid, compressing the trapped lint into a pellet, and fusing at least a portion of the lint in the pellet.

DESCRIPTION

Figure 1:
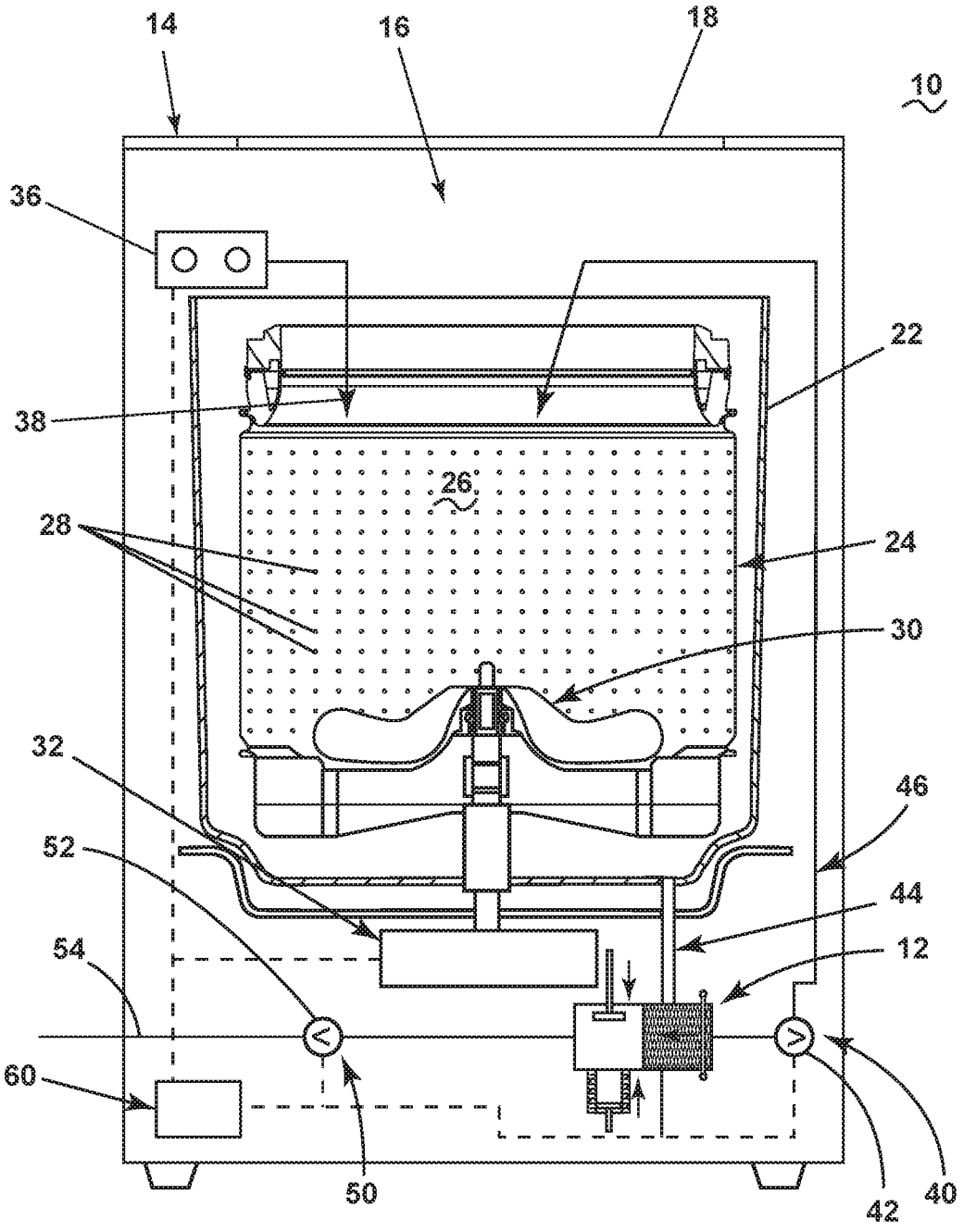
FIG. 1 is a schematic front view of a laundry treating appliance in the form of a clothes washer with a lint pelletizer.

FIG. 1 illustrates a laundry treating appliance in the form of a top-loading, vertical axis washing machine 10 incorporating a lint pelletizer 12. The vertical axis washing machine 10 comprises a chassis or cabinet 14 defining an interior 16 accessible through a top door 18. A tub 22 is located within the interior 16 and defines a fluid tank for holding water, wash liquid, and the like. A basket 24 is located within and rotatable relative to the tub 22. The basket 24 defines a treating chamber 26 for receiving laundry, such as clothes, for treatment. The basket 24 can have drain holes, such as perforations 28, through which liquid can pass to and from the tub 22.

A clothes mover shown as an impeller 30 is located within the treating chamber 26 and is rotationally driven by a motor 32, which can also rotate the basket 24. The impeller 30 is one example of a suitable clothes mover. Other clothes movers like an agitator, auger, nutator, etc. are contemplated.

A household water supply 36 is provided and supplies water, hot or cold, to the treating chamber 26 directly or indirectly. A dispenser 38 is fluidly coupled to the household water supply 36. The dispenser 38 can be filled with one or more charges of treating chemistry, which is then flushed into the treating chamber 26 from the household water supply 36.

A fluid recirculation circuit 40 is provided to recirculate liquid into the treating chamber 26. The recirculation circuit 40 comprises a recirculation pump 42 that is supplied by a sump or sump line 44 that is fluidly coupled to the tub 22. An output line 46 receives liquid from the recirculation pump 42 and returns the liquid to the treating chamber 26. A spray head 48 or some other type of distribution device or nozzle can be located on the end of the output line 46.

A fluid drain circuit 50 is provided to drain liquid from the treating chamber 26. The drain circuit 50 comprises a drain pump 52 that is supplied by the sump or sump line 44. A drain line 54 receives liquid from the drain pump 52 and sends the liquid to a household drain.

The pelletizer 12 is fluidly coupled to both of the recirculation and drain circuits 40, 50. In the illustrated implementation, the pelletizer forms a junction between both the circuits, but this is not necessary. The pelletizer 12 is situated such that it is supplied liquid from the sump line 44 and the supplied liquid can then be directed to the recirculation circuit 40 or drain circuit 50 by the activation of the corresponding recirculation pump 42 or drain pump 52.

A controller 60 is operably coupled to the pelletizer 12, motor 32, household water supply 36, recirculation pump 42, and drain pump 52 to control their respective operation during the implementing of a treating cycle of operation or sub-cycle of operation, such as a pelletizing cycle, where lint entrained in the liquid is formed into a pellet P. While shown in the lower left of the cabinet 14, the controller 60 can be located anywhere within or on the cabinet 14 and includes a user interface, which can be remote from the processor of the controller 60.

Figure 2:
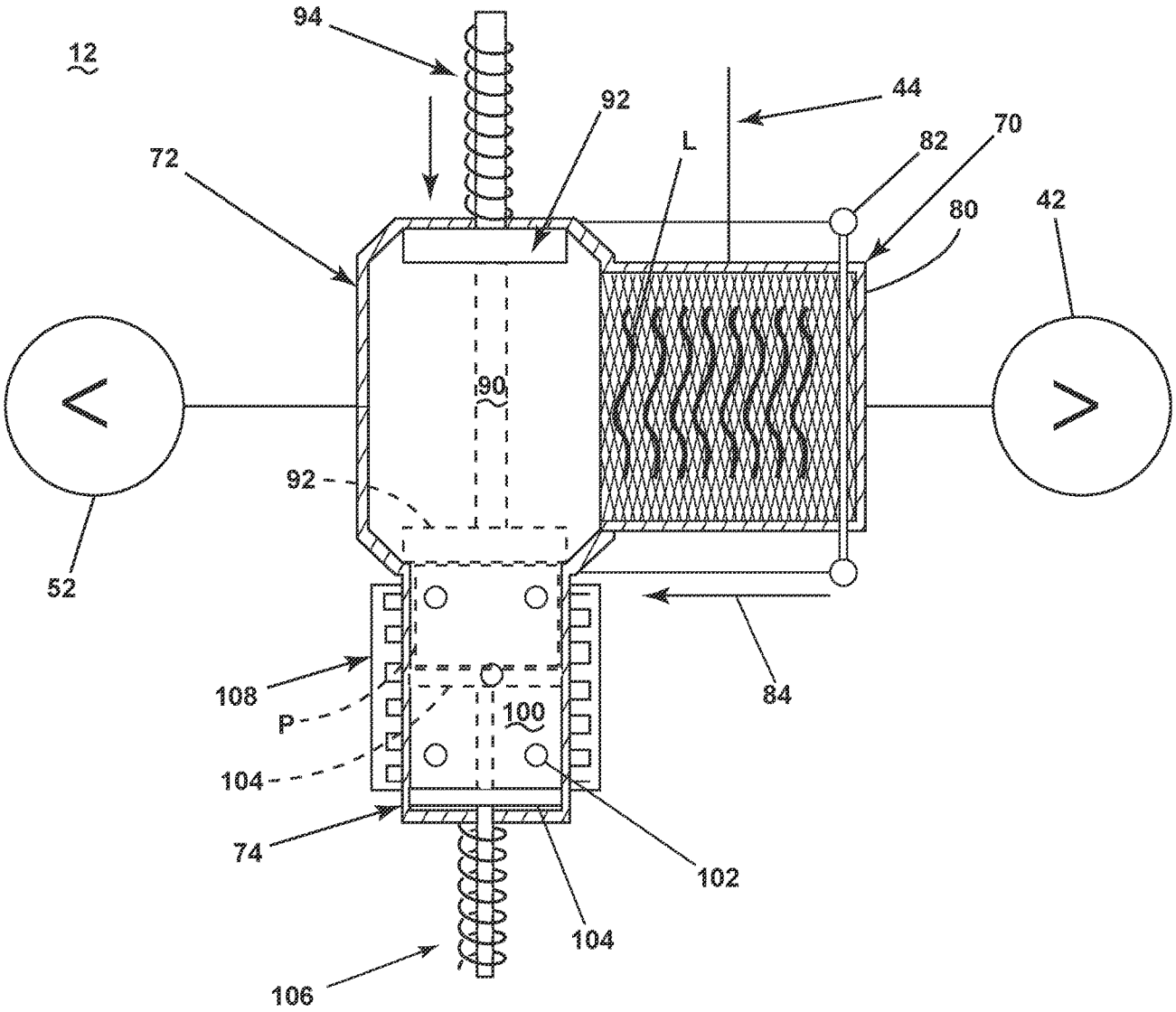
FIG. 2 is an enlarged view of the lint pelletizer of FIG. 1.

Referring to FIG. 2, the pelletizer 12 includes a lint trap 70, a hopper 72, and a ram 74, which are operationally interconnected to form a lint pellet P from lint entrained in the liquid. The lint trap 70 can be any suitable device for trapping lint and is illustrated as a filter in the form of a mesh or screen 80 through which passes the liquid from the sump line 44. A lint mover, which is illustrated as a wiper 82, moves over the screen 80 in the direction of arrow 84 to direct any lint trapped on the screen 80 into the hopper 72.

The hopper 72 defines a hopper chamber 90 for receiving the trapped lint. As illustrated, the hopper 72 can have a piston 92 that is reciprocated into and out of the hopper chamber 90 by an actuator, such as solenoid 94. The reciprocation of the piston 92 moves the lint in the hopper chamber 90 into the ram 74. The piston 92 is not necessary. In that sense, neither is the hopper 72. It is possible to configure the pelletizer such that the trapped lint can be moved to the ram 74 without the hopper 72.

The ram 74 defines a pellet chamber 100 having drain holes 102. A pellet piston 104 can be reciprocated within the pellet chamber 100 by an actuator, such as solenoid 106. If greater mechanical leverage is needed, a force multiplier, such as a gear train with motor, could be used. A heater, in the form of a film heater 108 surrounds the pellet chamber and thereby heats the contents of the pellet chamber 100. While a film heater 108 is illustrated, any type of heater can be used. For example, a coiled resistive heater could be wrapped around the pellet chamber 100 while leaving spaces, if need be, for the drain holes 102. In place of or in addition to the drain holes 102, a small gap can be left between the piston and the pellet chamber through which the water, water vapor, or steam can escape.

The wiper 82, solenoids 94, 106, and heater 108 are all operably coupled to the controller 60 and selectively controllable by the controller 60 to effect a suitable lint pelletizing operation. For example, during a typical treating cycle of operation, liquid will be recirculated through the recirculation circuit 40, with the liquid passing through the screen 80, which traps the lint L entrained within the liquid. The lint L trapped on the screen 80 can be moved by the wiper 82 into the hopper chamber 90. The piston 92 is then reciprocated into the hopper chamber 90 to move the lint L into the pellet chamber 100. The piston 92 can remain in a position closing off an upper end of the pellet chamber 100 to function as a back plate for the pellet piston 100. The pellet piston 100 can then be reciprocated into the pellet chamber 100 compressing the lint L against the piston 92 to form a pellet P of lint L. Liquid squeezed from the lint L during the forming of the pellet P can exit the pellet chamber 100 through the drain holes 102. The heater 108 can then be activated to heat the pellet chamber 100, which conducts heat to the pellet P, which is heated to a temperature sufficient to fuse together at least some of the outermost lint fibers forming the pellet P. After the fusing, the piston 92 is reciprocated out of the hopper chamber 90 and the pellet piston 100 is advanced further to expel the pellet P from the pellet chamber 100 into the hopper chamber 90, where the pellet P can be drained away with the liquid during a draining operation.

It is contemplated that since the lint L is likely to be wet at the time of pelletizing only a portion of the outermost fibers will be fused together. It is not necessary for all of the fibers of the pellet P to be fused. A suitable degree of fusing is any amount of fusing where most of the lint L forming the pellet P stays together as a mass, even if the mass does not retain the original pellet shape. The fusing can include a complete or partial melting of all, some or a portion of some of at least the outermost fibers. The fusing can result in a mechanical or chemical connection between some of the fibers. In a mechanical connection, the fused fibers become sufficiently soft, molten, or even fully melt along at least a portion of the fiber mechanically couple, once cooled, with an adjacent fiber, which may or may not have become soft, molten or fully melt. In a chemical connection, the heat can provide sufficient energy for the chemicals of adjacent fibers to chemical break their bonds and form new bonds with each other. In most cases, it is anticipated that the likely fibers will result in a mechanical connection.

It is further contemplated that a suitable pellet size is a cylinder on the order of a ¼" diameter and a ½" in length. While the pellet P can be any shape and size, as it is contemplated that the pellet P will be drained away. Thus, the pellet P need be small enough that it will not clog any household plumbing, yet large enough that it is easily captured by a municipal water treatment plant. It is also contemplated that the pellet P can be stored within the laundry treating appliance for removal by a user.

The implementation of the pelletizing cycle can take place at any time. It can be initiated before or as part of the drain phase, where liquid is drained from the laundry treating appliance. It can be implemented multiple times during a given cycle of operation, after a certain number of cycles of operation, after an amount of time of operation, or a sensor can be provided to sense the amount of lint L accumulated on the screen 80.

Figure 3:
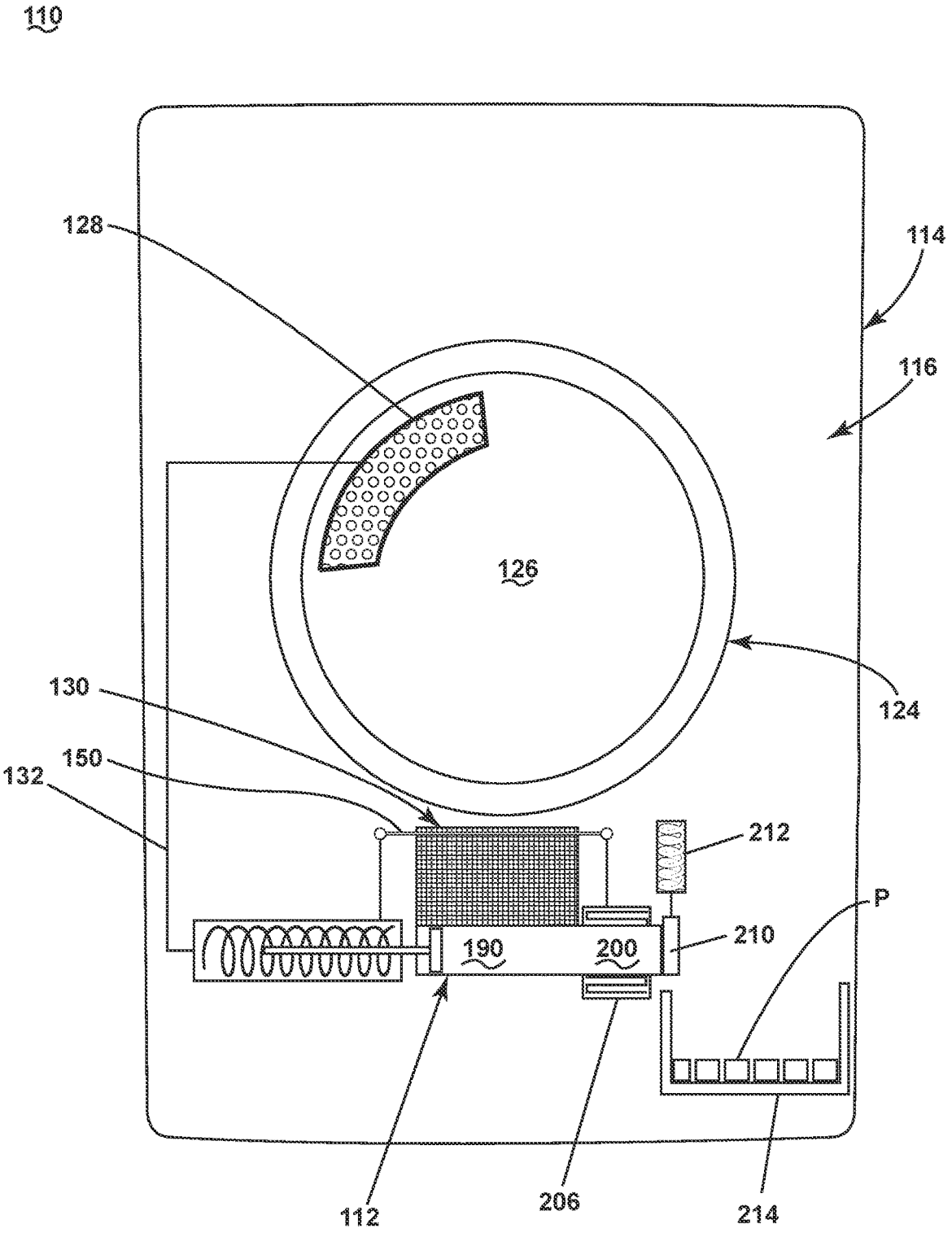
FIG. 3 is a schematic front view of a laundry treating appliance in the form of a clothes dryer with a lint pelletizer.
Figure 4:
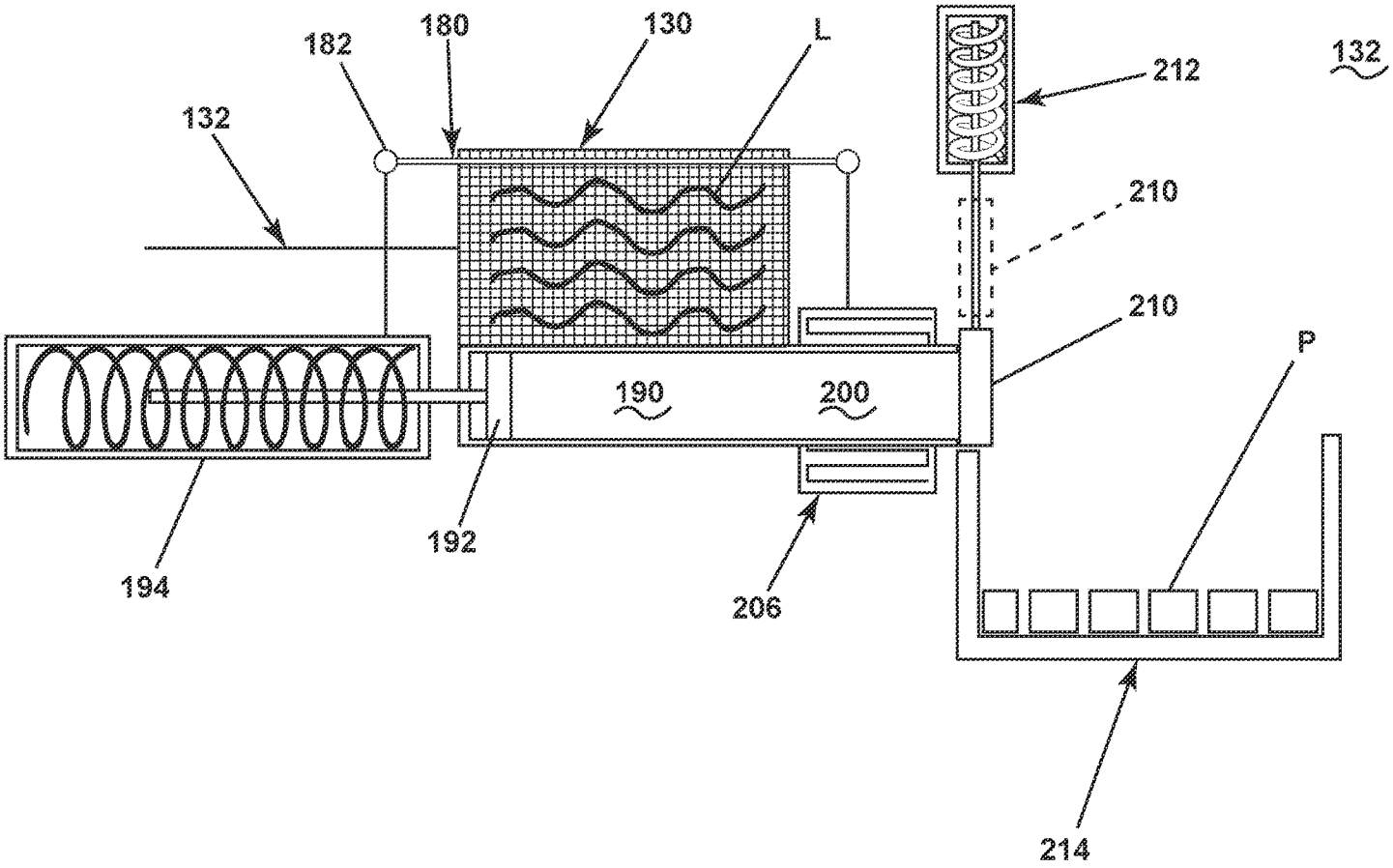
FIG. 4 is an enlarged view of the lint pelletizer of FIG. 3.

The pelletizer 12 can be implemented in other fabric treating appliances than a vertical axis clothes washer. It can, for example, be implemented in a horizontal axis clothes washer. As seen in FIG. 3, a pelletizer 112 can be implemented as a clothes dryer 110. As the basic structure of a clothes dryer 110 is known, only the structure and features needed to set the environment for the pelletizer 112 are described. The clothes dryer 110 includes a cabinet 114 that defines an interior 116 housing a rotating drum 124 defining a treating chamber 126, which receives fluid, in the form of air, through an inlet vent 128, and exhausts air through an exhaust vent 130. The air is continuously recirculated via a recirculation circuit 132 through the treating chamber 126 by recirculating the air exiting the exhaust vent 130 back to the inlet vent 128.

The pelletizer 112 is located within the recirculation circuit 132. The pelletizer 112 has an almost identical structure to the pelletizer 12, with identical parts increased by 100, in that it has a lint trap 170 in the form of a screen 180 with a wiper 182; a hopper 172 with a hopper chamber 190, piston 192, and solenoid 106; a ram 174 with a pellet chamber 200; and a heater 206. These identical structures will not be described in detail as the description of these structures for the pelletizer 12 applies. What will be described are the primary differences in the pelletizer 112 as compared to the pelletizer 12.

As can readily be seen, the pelletizer 112 does not include a separate pellet piston 104. Instead, a back plate 210 having a corresponding solenoid 212 is provided and takes the place of the pellet piston 104. An output bin 214 is provided by the back plate 210.

The operation of the pelletizer 112 is essentially the same as described for the pelletizer 12 in that the wiper 180 moves the lint L captured on the screen 180 into the hopper chamber 190, the piston 192 moves the lint L from the hopper chamber 190 into the pellet chamber 200. What differs is that the piston 192 is also used to compress the lint L in the pellet chamber 200 against the back plate 210. Once the lint L is compressed into a pellet, the heater 206 is actuated to fuse the lint L. After fusing, the solenoid 212 is actuated to withdraw the back plate 210 and open the pellet chamber 200, where further advancement of the piston 192 expels the pellet into the output bin 214 for storage until removed by a user.

The invention claimed is:

1. A laundry treating appliance comprising:

a treating chamber with a fluid circuit coupled to a lint trap; and a lint pelletizer including a ram configured to form lint trapped from the lint trap into a pellet.

2. The laundry treating appliance of claim 1 further comprising a hopper to hold the lint prior to forming into a pellet.

3. The laundry treating appliance of claim 2 wherein the lint trap comprises a lint mover that moves the lint from the lint trap into the hopper.

4. The laundry treating appliance of claim 3 wherein the hopper comprises a hopper piston reciprocating within the hopper to move the lint from the hopper into the lint pelletizer.

5. The laundry treating appliance of claim 2 further comprising a heater located at the hopper.

6. The laundry treating appliance of claim 1 wherein the ram defines a pellet chamber.

7. The laundry treating appliance of claim 6 wherein a heater is located around at least a portion of the pellet chamber.

8. The laundry treating appliance of claim 6 wherein the pellet chamber has drain holes.

9. The laundry treating appliance of claim 1 wherein the ram further comprises a piston reciprocating the ram to compress the lint into the pellet.

10. The laundry treating appliance of claim 1 further comprises a hopper connecting the lint trap to the lint pelletizer.

11. A lint pelletizer for pelletizing lint captured within a household appliance, the lint pelletizer comprising:

a ram configured to form the lint trapped from the lint trap into a pellet; and a pellet chamber at least partially defined by the ram.

12. The lint pelletizer of claim 11 wherein a heater is located around at least a portion of the pellet chamber.

13. The lint pelletizer of claim 12 wherein the pellet chamber has drain holes.

14. The lint pelletizer of claim 11 further comprises a piston reciprocating the ram to compress the lint into the pellet.

15. A method for pelletizing lint entrained in waste liquid in a household appliance, the method comprising:

trapping the lint from the waste liquid;

compressing the trapped lint into a pellet; and fusing at least a portion of the lint in the pellet.

16. The method of claim 15 wherein the fusing comprises fusing at least some of the lint on an exterior of the pellet.

17. The method of claim 15 wherein the fusing comprises applying sufficient heat to at least soften at least some of the lint on an exterior of the pellet.

18. The method of claim 17 wherein the applied heat is sufficient to render molten at least some of the lint on the exterior of the pellet.

19. The method of claim 18 wherein the applied heat is sufficient to melt at least some of the lint on the exterior of the pellet.

20. The method of claim 15 wherein the pellet is less than ¼" wide and ½" long.

* * * * *